US005985106A

United States Patent [19]

Velasquez

[11] Patent Number: 5,985,106

[45] Date of Patent: Nov. 16, 1999

[54] CONTINUOUS RACK PLATER

[76] Inventor: Geronimo Z. Velasquez, 9206 Guadalupe Trail, Albuquerque, N.Mex. 87114

[21] Appl. No.: 08/679,734

[22] Filed: Jul. 12, 1996

Related U.S. Application Data

[60] Provisional application No. 60/001,171, Jul. 14, 1995.

[51] Int. Cl.[6] ..... C25D 17/00; C25B 15/00; B05C 3/02; B05C 3/00

[52] U.S. Cl. ..... 204/202; 204/203; 204/237; 118/412; 118/415; 118/426

[58] Field of Search ..... 204/202, 203, 204/237; 118/412, 415, 426

[56] References Cited

U.S. PATENT DOCUMENTS

| | | | |
|---|---|---|---|
| 2,043,698 | 6/1936 | Dyer | 204/5 |
| 2,142,829 | 1/1939 | Trudeau | 204/5 |
| 2,255,922 | 9/1941 | Finston | 204/202 |
| 2,387,160 | 10/1945 | Loney | 198/179 |
| 2,428,141 | 9/1947 | Burkhardt | 204/140 |
| 3,226,308 | 12/1965 | Pochapsky | 204/26 |
| 3,657,097 | 4/1972 | Baldock | 204/202 |
| 3,681,210 | 8/1972 | Zievers et al. | 204/237 |
| 4,189,360 | 2/1980 | Woods | 204/58 |
| 4,263,122 | 4/1981 | Urquhart | 204/300 EC |
| 4,377,461 | 3/1983 | Lovejoy | 204/198 |
| 4,425,212 | 1/1984 | Francis | 204/202 |
| 4,501,650 | 2/1985 | Maron | 204/198 |
| 4,539,090 | 9/1985 | Francis | 204/198 |
| 4,812,211 | 3/1989 | Sakai | 204/180.2 |

OTHER PUBLICATIONS

Meaker Variable Speed Plating Machine, Dec. 5, 1932.

*Primary Examiner*—Kathryn Gorgos
*Assistant Examiner*—Edna Wong
*Attorney, Agent, or Firm*—Deborah A. Peacock; Jeffrey D. Myers; Brian J. Pangrle

[57] ABSTRACT

A continuous plating system which is horizontal, allows for submersion of the entire article to be plated, and is useful for alloy plating. The invention provides a link/hinge conveyor system, the conveyor acts as the conductor, numerous processes/baths are possible, and difficult to plate alloys, such as a tin/bismuth plate can be produced. Homogeneous alloys are possible with the present invention. Also disclosed are novel dryer and rinse systems for use with the continuous plating system.

44 Claims, 11 Drawing Sheets

Scanning Electron Photomicrograph of Sn/Bi Coating
SEI Mode

Scanning Electron Photomicrograph of Sn/Bi Coating
Composition Mode

CONTINUOUS RACK PLATER

CROSS-REFERENCE TO RELATED APPLICATIONS

The present application is a utility patent application which claims priority to Provisional Application Ser. No. 60/001,171, entitled "Continuous Rack Plater," filed Jul. 14, 1995, the teachings of which are incorporated herein by reference.

BACKGROUND OF THE INVENTION

The present invention relates to a plater which continuously plates articles. The invention is suitable for single substance or alloy plating. The invention further provides novel rinse and dryer methods and devices.

There are numerous continuous platers in the prior art. For instance, U.S. Pat. No. 2,142,829, entitled "Plating Machine" to J. F. Trudeau; U.S. Pat. No. 2,255,922, entitled "Return Type Fast Transfer Machine" to V. Finston; U.S. Pat. No. 2,428,141, entitled "Process for Cleaning, Stripping, and Polishing Metal Surfaces" to T. E. Burkhardt; U.S. Pat. No. 2,387,160, entitled "Article Handling Apparatus" to W. W. Loney; U.S. Pat. No. 4,189,360, entitled "Process for Continuous Anodizing of Aluminum" to Woods, et al.; U.S. Pat. No. 4,263,122, entitled "Electrocoating Equipment" to Urquhart; and Meaker Variable Speed Plating Machine pamphlet; all disclose a single bath continuous plating system. However, these references do not disclose multiple baths. In addition, the U.S. Pat. Nos. '122, '360 and '141 patents do not teach a horizontal system, but lower and lift articles or parts to be plated into the bath. The U.S. Pat. No. '160 patent describes plating only a portion of the article, leaving the rest above the plating bath. U.S. Pat. No. 2,043,698, entitled "Method and Apparatus for Spacing Electrodes" to J. P. Dyer discloses spacing anodes for a plating operation.

Other prior art patents disclose multiple plating baths or processes, such as U.S. Pat. No. 3,266,308, entitled "Electrochemical Treating and Apparatus" to H. Pochapsky, et al.; U.S. Pat. No. 3,657,097, entitled "Selective Plating Machines" to Baldock, et al.; U.S. Pat. No. 4,377,461, entitled "Tab Plater for Circuit Boards or the Like" to Lovejoy; U.S. Pat. No. 4,501,650, entitled "Workpiece Clamp Assembly for Electrolytic Plating Machine" to Maron; U.S. Pat. No. 4,539,090, entitled "Continuous Electroplating Device" to Francis; and U.S. Pat. No. 4,812,211, entitled "Process and System for Electrodeposition Coating" to Sakai. The U.S. Pat. Nos. '211 and '309 patents disclose complicated movement systems; the U.S. Pat. No. '211 patent provides for the articles to be plated to be disposed in baskets. The U.S. Pat. Nos. '211, '090, '650, 097' and '461 patents all disclose chain conveyor systems, some with hoists for lowering and lifting the parts into the baths/processes. The U.S. Pat. Nos. '090, '650, '097, and '461 patents all disclose plating only a portion of the article, rather than submerging the entire article into the plating tank.

The present invention, on the other hand, allows for multiple bath plating, alloy plating, submersion of the entire article, a novel horizontal conveyor/drive system and recycling of most process streams.

SUMMARY OF THE INVENTION (DISCLOSURE OF THE INVENTION)

The present invention is of a continuous plating system and method for plating articles comprising: multiple baths, wherein at least one bath comprises a plating bath; a continuous conveyor system for passing the articles through the multiple baths comprising a drive, a conveyor comprising alternating links and hinges, and numerous carriers for attaching numerous articles to the conveyor; and a conductor for providing electricity to the articles while being conveyed. In the preferred embodiment, the links comprise feet to be driven by the drive and the feet provide electrical current continuity between the conductor and the carriers. A preferred support bar for the conveyor is made of a synthetic resin polymer, (e.g., Teflon), and the conveyor and the carriers are preferably (silver) plated to provide electrical conductivity. The plating bath comprises at least one anode for plating the anode substance onto the articles, an upper tank disposed within a lower tank for providing overflow and recirculation of a plating solution, a narrow opening and a narrow exit corresponding substantially in shape and width to the articles (and preferably comprising adjustments for changing the shape and size of the opening and exit), multiple pumps for providing even plating conditions to the articles, and multiple spray jets for providing even circulation and plating to the articles. Internal guides are best used within at least one of the multiple baths for preventing sway of the articles and external guides external to at least one of the multiple baths for providing ease of movement of the articles into the bath. The articles may be flat or non-planar. The carriers preferably have hooks which hook into an opening in the articles. The system preferably has an oval configuration and applies additional direct current by exposed cable or brushes. The system best further comprises a dryer in line with the continuous plating system and positioned after the multiple baths, the dryer comprising: a box comprising a heated fluid; an entry opening for the articles to enter the box; and an exit opening for the articles to exit the box, as well as a wicking device (such as a mesh material in the box) to help remove moisture from the articles. The system also best employs a rinse system in line with the continuous plating system and positioned after the multiple baths, the rinse system comprising: a first rinse station wherein a substance from the multiple baths is rinsed from the articles, the first rinse station comprising an effluent with a higher concentration of the substance; and at least one additional rinse station wherein the substance is further rinsed from the articles, the additional rinse station comprising an effluent with a lower concentration of the substance; and for recycling effluent from the rinse station back into the continuous plating system (preferably with at least four rinse stations). The articles are preferably completely submerged within the plating bath(s). Most preferably, the plating system comprises: at least three plating baths, wherein the first bath comprises a substance to be plated on the articles, the second bath comprises a different substance to be plated on the articles and the third bath comprises the same substance as the first bath to be plated on the articles, the substances comprising an alloy plate (preferably tin and bismuth) on the articles; a continuous conveyor system for passing the articles through the multiple baths comprising a drive, a conveyor, and numerous carriers for attaching numerous articles to the conveyor; and a conductor for providing electricity to the articles while being conveyed. Most preferably, the system uses at least five plating baths in the following order and comprising the following in solution to be plated on the articles: tin, bismuth, tin, bismuth and tin. However, the system can be used to plate many metal alloys, including tin, bismuth, lead, titanium, cadmium, nickel, and zinc, and combinations thereof. Further, the system preferably has at least one bath comprises a plating bath, and the other baths comprise at least one process bath selected from the group consisting of cleaning, electrocleaning, degreasing, rinsing, drying, fluxing, reflowing and stripping, most preferably at least the following baths in the following order: a cleaning bath; a rinsing bath; a plating bath; and a rinsing bath, preferably with a drying station subsequent to the final rinsing bath. The conveyor may comprise the conductor, so as to provide electricity to the articles while being conveyed thereon. Here, synthetic resin polymers bars (e.g., Teflon bars) may be used to support the conveyor.

The invention is also of a continuous plating system and method for plating articles comprising: multiple baths, wherein at least one bath comprises a plating bath; a horizontal continuous conveyor system for passing the articles through the multiple baths while completely submerging the articles in the multiple baths, comprising a drive, a conveyor, and numerous carriers for attaching numerous articles to the conveyor; and a conductor for providing electricity to the articles while being conveyed. At least one of the multiple baths should comprise a stripping bath positioned after the plating bath for stripping the carriers of a substance plated on the carriers in the plating bath.

The invention is also of a continuous plating system and method for plating articles comprising: multiple baths, wherein at least one bath comprises a plating bath, and the other baths comprise at least one process bath selected from the group consisting of cleaning, electrocleaning, degreasing, rinsing, drying, fluxing, reflowing and stripping; a continuous conveyor system for passing the articles through the multiple baths comprising a drive, a conveyor, and numerous carriers for attaching numerous articles to the conveyor; and a conductor for providing electricity to the articles while being conveyed. In the preferred embodiment, at least the following baths in the following order are employed: a cleaning bath; a rinsing bath; a plating bath; and a rinsing bath, and preferably a drying station subsequent to the final rinsing bath.

The invention is additionally of a continuous plating system and method for alloy plating of articles comprising: at least three plating baths, wherein the first bath comprises a substance to be plated on the articles, the second bath comprises a different substance to be plated on the articles and the third bath comprises the same substance as the first bath to be plated on the articles, the substances comprising an alloy plate on the articles; a continuous conveyor system for passing the articles through the multiple baths comprising a drive, a conveyor, and numerous carriers for attaching numerous articles to the conveyor; and a conductor for providing electricity to the articles while being conveyed. The system best further comprises a dryer in line with the continuous plating system and positioned after the multiple baths, the dryer comprising: a box comprising a heated fluid; an entry opening for the articles to enter the box; and an exit opening for the articles to exit the box, as well as a wicking device (such as a mesh material in the box) to help remove moisture from the articles. The system also best employs a rinse system in line with the continuous plating system and positioned after the multiple baths, the rinse system comprising: a first rinse station wherein a substance from the multiple baths is rinsed from the articles, the first rinse station comprising an effluent with a higher concentration of the substance; and at least one additional rinse station wherein the substance is further rinsed from the articles, the additional rinse station comprising an effluent with a lower concentration of the substance; and for recycling effluent from the rinse station back into the continuous plating system (preferably with at least four rinse stations). The articles are preferably completely submerged within the plating bath(s). Most preferably, the plating system comprises: at least three plating baths, wherein the first bath comprises a substance to be plated on the articles, the second bath comprises a different substance to be plated on the articles and the third bath comprises the same substance as the first bath to be plated on the articles, the substances comprising an alloy plate (preferably tin and bismuth) on the articles; a continuous conveyor system for passing the articles through the multiple baths comprising a drive, a conveyor, and numerous carriers for attaching numerous articles to the conveyor; and a conductor for providing electricity to the articles while being conveyed. Most preferably, the system uses at least five plating baths in the following order and comprising the following in solution to be plated on the articles: tin, bismuth, tin, bismuth and tin. However, the system can be used to plate many metal alloys, including tin, bismuth, lead, titanium, cadmium, nickel, and zinc, and combinations thereof. Further, the system preferably has at least one bath comprises a plating bath, and the other baths comprise at least one process bath selected from the group consisting of cleaning, electrocleaning, degreasing, rinsing, drying, fluxing, reflowing and stripping, most preferably at least the following baths in the following order: a cleaning bath; a rinsing bath; a plating bath; and a rinsing bath, preferably with a drying station subsequent to the final rinsing bath. The conveyor may comprise the conductor, so as to provide electricity to the articles while being conveyed thereon. Here, synthetic resin polymer bars (e.g., Teflon bars) may be used to support the conveyor.

The invention is still further of a continuous plating system and method for plating articles comprising: multiple baths, wherein at least one bath comprises a plating bath; and a continuous conveyor system for passing the articles through the multiple baths comprising a drive, a conveyor comprising a conductor for providing electricity to the articles while being conveyed, and numerous carriers for attaching numerous articles to the conveyor. The preferred embodiment preferably comprises Teflon bars to support the conveyor when no direct current is present.

The invention is yet further of a continuous plating system and method for plating articles comprising multiple baths, wherein at least one bath comprises a plating bath; a horizontal continuous conveyor system for passing the articles through the multiple baths comprising a drive, a conveyor, and numerous carriers for attaching numerous articles to the conveyor; and a conductor for providing electricity to the articles while being conveyed; the invention further comprising: a dryer in line with the continuous plating system and positioned after the multiple baths, the dryer comprising: a box comprising a heated fluid; an entry opening for the articles to enter the box; and an exit opening for the articles to exit the box. The preferred embodiment includes a wicking device for wicking moisture from the articles, such as a mesh material disposed in the box (preferably at the bottom), and internal guides for stabilizing the articles within the box.

The invention is additionally of a continuous plating system and method for plating articles comprising multiple baths, wherein at least one bath comprises a plating bath; a horizontal continuous conveyor system for passing the articles through the multiple baths comprising a drive, a conveyor, and numerous carriers for attaching numerous articles to the conveyor; and a conductor for providing electricity to the articles while being conveyed; the invention further comprising: a rinse system in line with the continuous plating system and positioned after the multiple baths, the rinse system comprising: a first rinse station wherein a substance from the multiple baths is rinsed from the articles, the first rinse station comprising an effluent with a higher concentration of the substance; and at least one additional rinse station wherein the substance is further rinsed from the articles, the additional rinse station comprising an effluent with a lower concentration of the substance; and for recycling effluent from the rinse station back into the continuous plating system. Preferably, the improvement employs at least four rinse stations.

A primary object of the present invention is to provide a continuous, multiple bath plating system, capable of single substance or alloy plating.

Another object of the present invention is to provide a continuous plating system which allows for submersion of the entire article into each bath.

Yet another object of the present invention is to provide for a continuous, horizontal conveyor system, which utilizes links and hinges.

Another object of the present invention is to provide recycling of most process streams.

A primary advantage of the present invention is that numerous articles can be plated in a short time frame, in an efficient and low cost manner.

Another advantage of the present invention is that alloy plating can be provided, including homogeneous alloys.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The file of this patent contains at least one drawing executed in color. Copies of this patent with color drawing (s) will be provided by the Patent and Trademark Office upon request and payment of the necessary fee.

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENT

The present invention relates to a continuous rack plater for continuously plating of flat parts and parts with angles or relief. The invention allows for plating with single or multiple substances.

Figure 6:
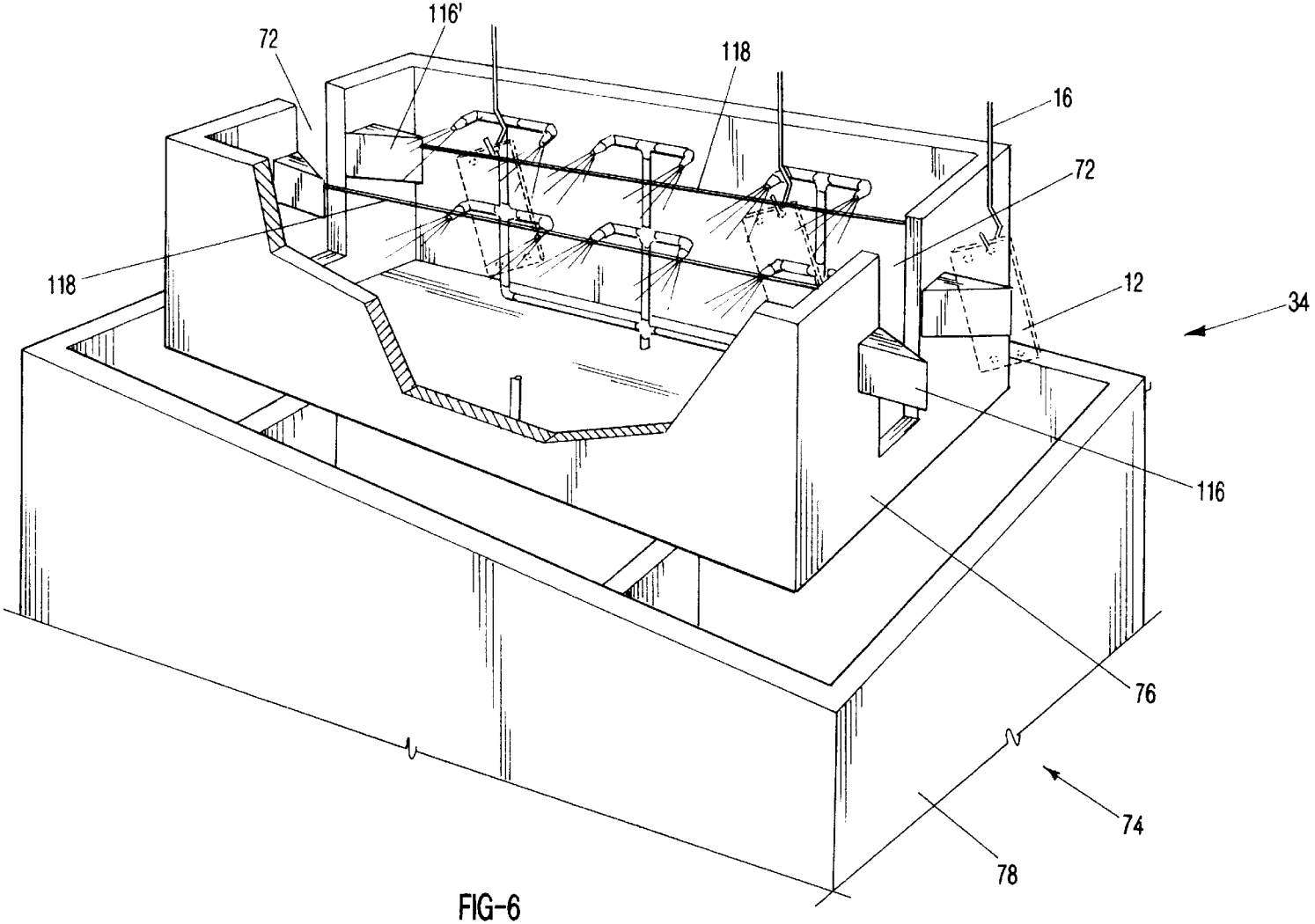
FIG. 6 is a cutaway end view of the preferred tank entry configuration of the invention of FIG. 1 for flat parts to be plated.
Figure 7:
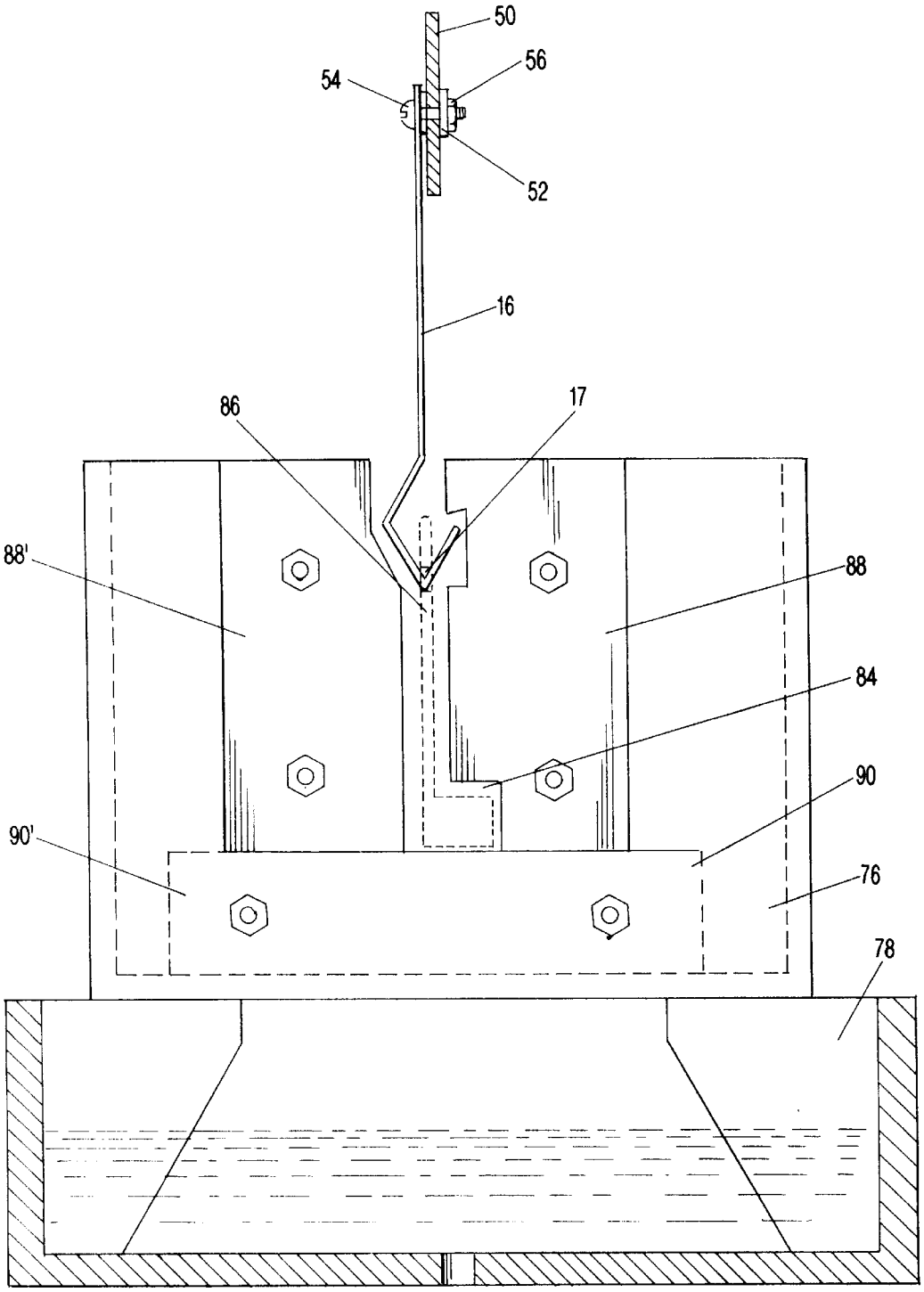
FIG. 7 is a cutaway end view of an alternative tank entry configuration of the invention of FIG. 1 for angled parts to be plated.
Figure 9:
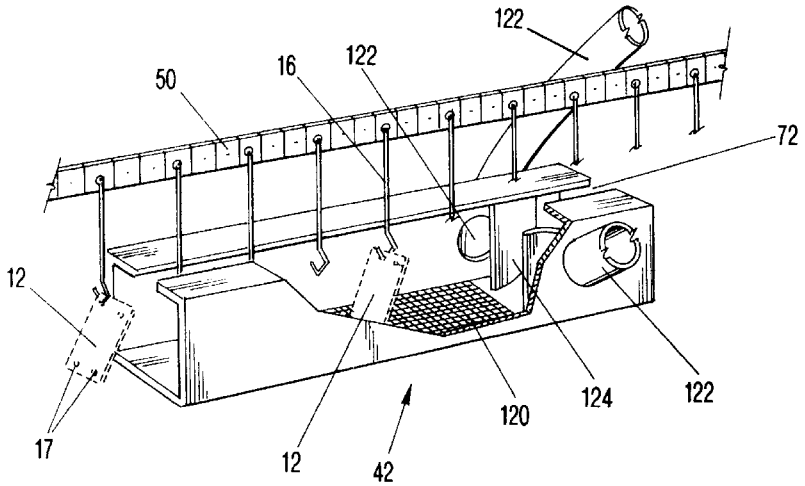
FIG. 9 is a perspective view of the preferred dryer configuration of the invention of FIG. 1.

With reference to the drawings, continuous rack plater 10 provides for plating of numerous, multiple parts (e.g., see a flat part 12 shown in FIGS. 6 and 9 and an angled part 86 in FIG. 7). The parts 12 to be plated are loaded or otherwise placed 13 on hooks 16 disposed on conveyor belt 18. The loading 13 and unloading 44 may be accomplished by a human operator or by automatic equipment (not shown) (e.g., a ramp which pushes the parts 12 off). Conveyor belt 18 travels (see direction of arrows in FIGS. 2 and 10) around drive pulley 20 on one end and idler pulleys 22, 22' and 22". Drive gear 24 powers and drives drive pulley 20 so that conveyor belt 18, with hooks 16 containing parts 12, can revolve through various cycles, equipment and processes (preferred embodiments discussed below). The invention is not limited to the particular cycles and processes described herein, as any steps, cycles, processes, solutions, substances to be plated, etc., can be used in accordance with the present invention. The term "plating" as used throughout the specification and claims is intended to include all forms of electrochemical processing such as electroplating, electroforming, electrocoating, electrodeposition, coating, stripping, alloying, and the like.

In the first step of the present invention, parts 12 are disposed on conveyor 18. The hooks 16 shown in the drawings are only one possible means for disposing the parts 12 to be plated on conveyor 18, and are particularly useful when the parts have a hole therethrough 17. Different sized hooks can be used for different articles and are easily removed and replaced on the conveyor. Other attachment means, e.g., slots, magnets, wires, strips, holes, etc., may be used for disposing parts 12 to be plated on conveyor 18.

Conveyor belt 18 acts as a conductor for the plating. In the preferred embodiment, continuous rack plater 10 is in an oval configuration so that power lines and piping lines can be more easily provided to the plater 10.

Figure 1:
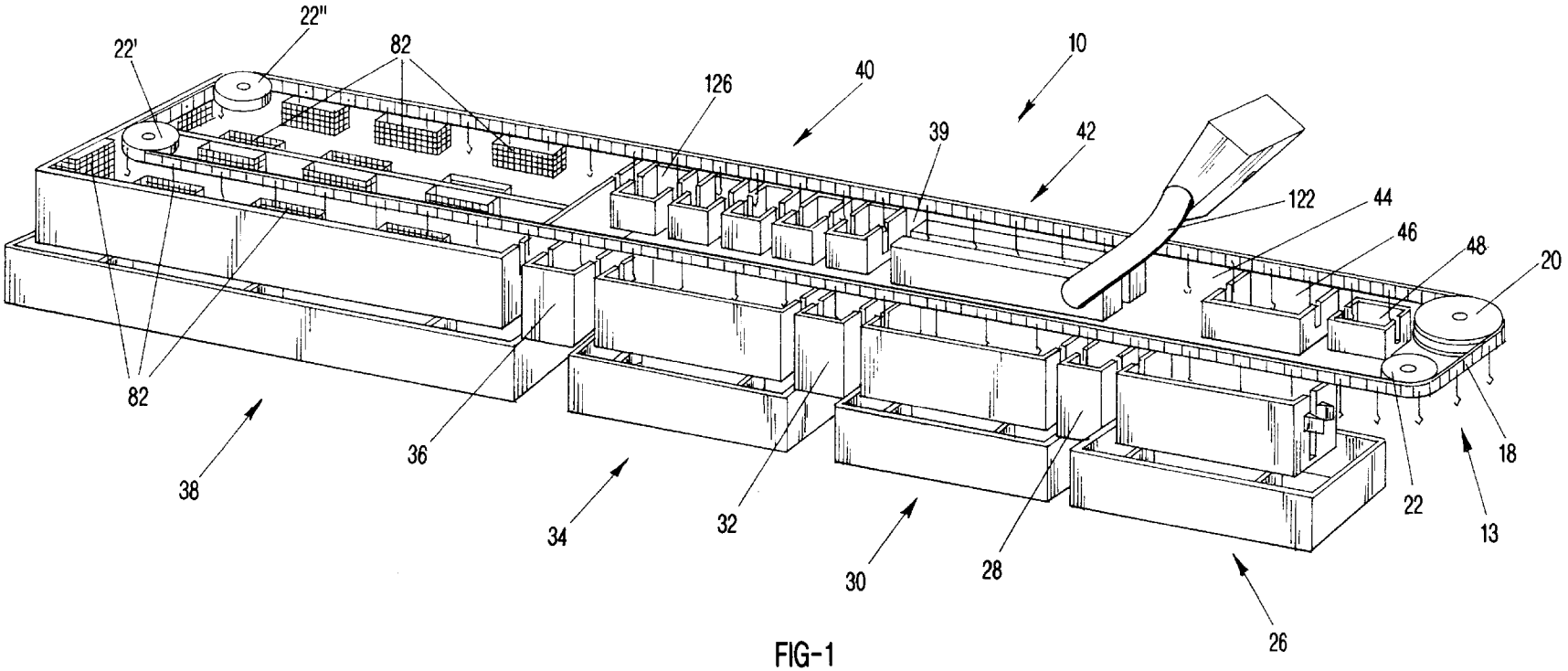
FIG. 1 is a perspective view of the continuous rack plater of the present invention.
Figure 2:
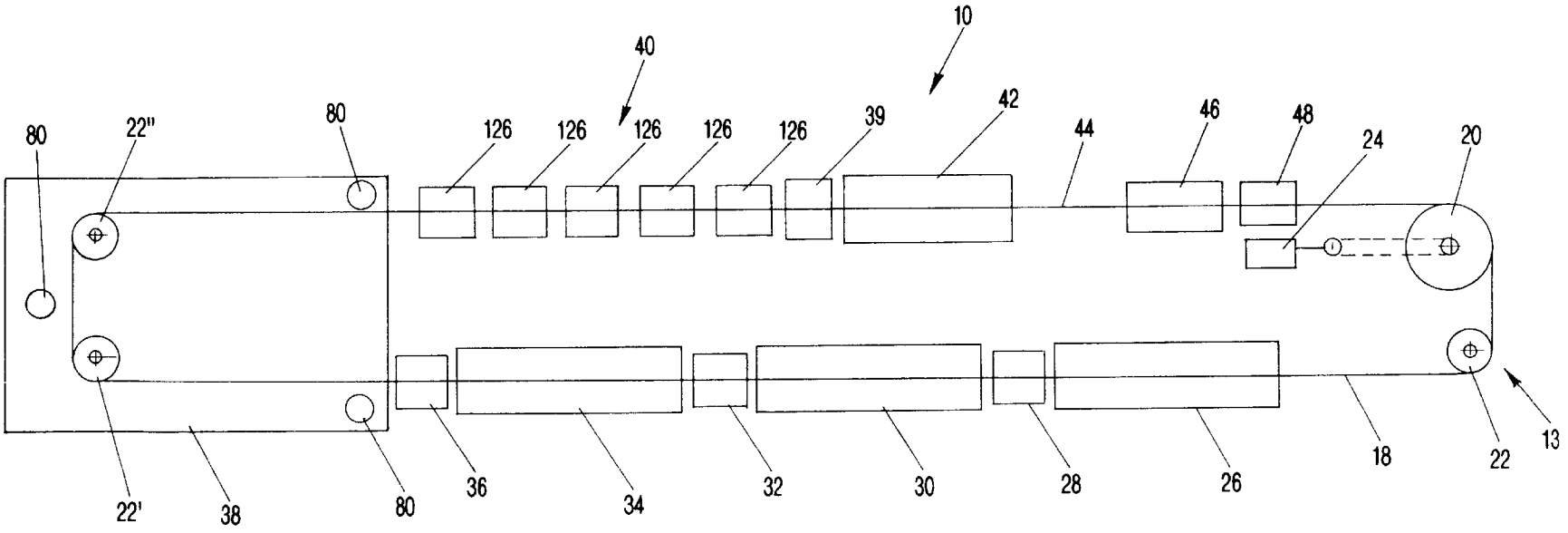
FIG. 2 is a top flowchart view of the preferred embodiment of the invention of FIG. 1.

Reference is made to FIG. 2 of the invention which illustrates a typical process embodiment of the invention of FIG. 1. The arrows show the direction of travel of conveyor 18. As shown in this flowchart, parts 12 are loaded 13 onto conveyor 18. If the parts 12 are dirty or oily they can pass through a cleaner or degreaser 26. A typical degreaser, useful in the present invention, comprises a spray box with nozzles which spray a detergent solution on the parts. The spray nozzles can be made to provide turbulent flow (e.g., using a narrow nozzle) or laminar flow (e.g., using a wide nozzle), depending on the extent of the degreasing 26 necessary and the stability of the parts 12. The parts 12 are then rinsed 28 (e.g., with spray nozzles) and can then be cleaned again in an electrocleaner 30 (e.g., a standard plater's detergent solution with anodes (e.g., hanging over the edges) for scrubbing hydrogen on the surface of the parts 12). After electrocleaner 30, parts 12 are rinsed again 32 (e.g., with spray nozzles). Parts 12 then travel through an acid bath 34 (e.g., typical plater's acid bath solution) to remove very light oxides (e.g., rust) and neutralize any remaining detergent. Parts 12 are then rinsed 36 again (e.g., with spray nozzles) prior to entering the plating bath 38. Plating bath 38 contains typical plater's solutions for plating substances (e.g., nickel or other metals or alloys) onto parts 12. After parts 12 exit plating bath 38 they are rinsed 40 (e.g., with spray nozzles) and then dried in dryer 42 (e.g., using hot air). Preferably, parts 12 are subjected to a blower 39 prior to the dryer 42 to remove much of the rinse stream 40. Parts 12 are then unloaded 44 and are complete. Hooks 16 which are now empty of parts 12 are then stripped 46 (e.g., using typical stripping solutions) and then rinsed 48 prior to being reloaded 13 for plating on continuous rack plater 10. As can be seen, the number and types of tanks and stations and processes depend entirely on the part to be plated, the thickness and final characteristics desired, the incoming character of the part, etc. For instance, some parts may not require cleaning or rinsing, whereas other parts may required multiple plating steps. The present invention is not limited to the particular processes described herein.

Figure 3:
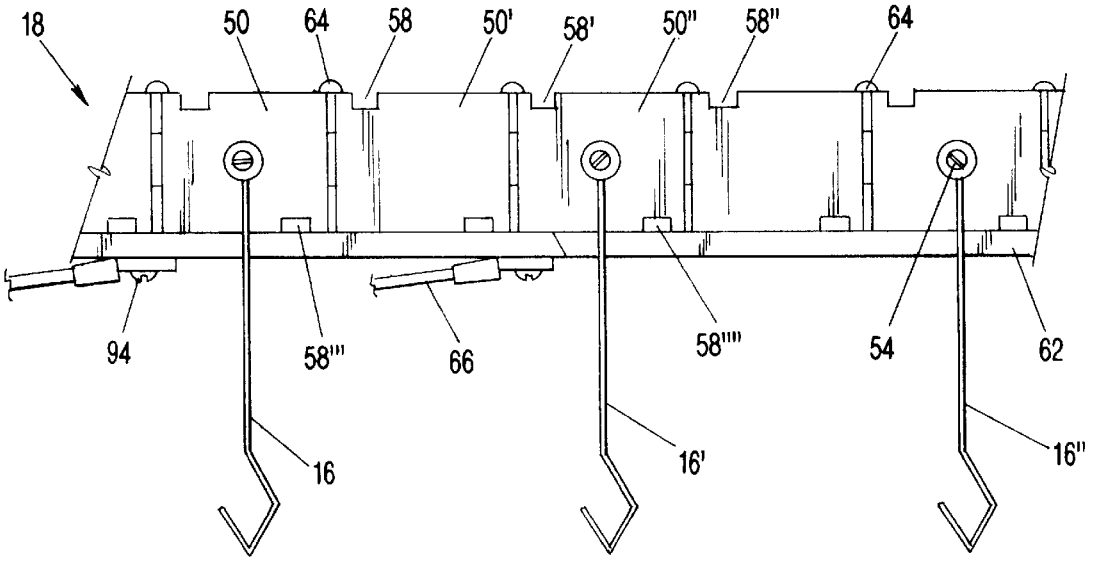
FIG. 3 is a side view of the preferred hook and rail configuration of the invention of FIG. 1.
Figure 4:
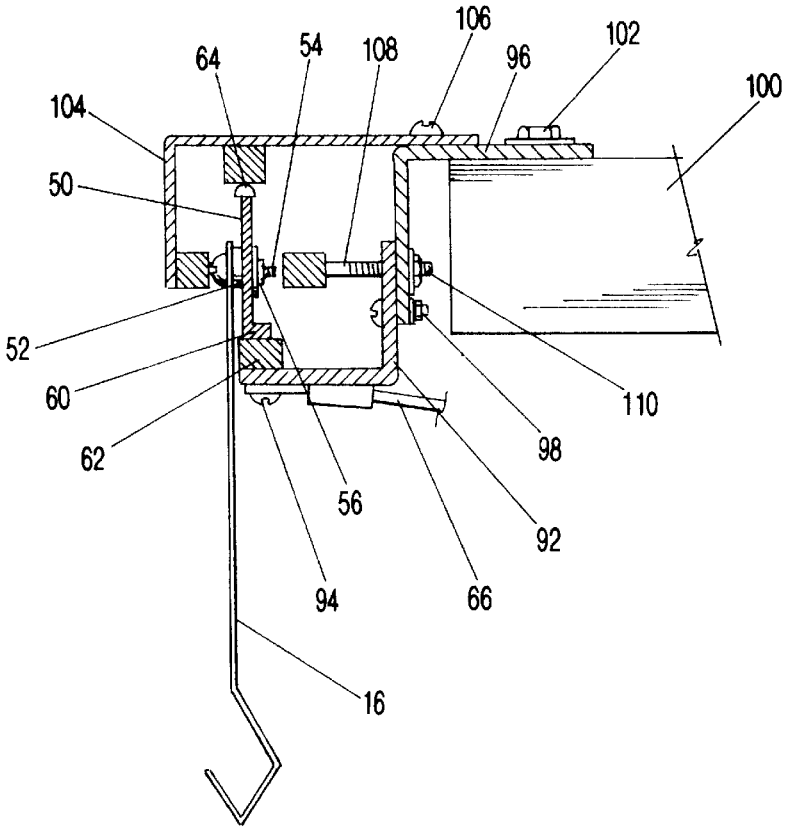
FIG. 4 is a cutaway end view of the preferred hook and rail configuration of the invention of FIG. 1.

With reference to FIGS. 3 and 4, the preferred attachment of hook 16 to conveyor 18 is shown. Conveyor (which acts as a conductor) preferably comprises individual links 50, 50' (e.g., made of brass or steel and plated with silver or other conductive and corrosion protection coatings). Hooks 16, 16' are preferably attached to links 50, 50' via a washer 52, screw 54 and nut 56. Link 50 comprises slots 58, 58' and foot 60 to be driven by drive gear 24. Foot 60 aids travel of link 50 on conductor bar or Synthetic resin polymer bar (e.g., Teflon bars) 62 and provides current continuity between conductor bar 62 and hook 16. Hinge pin 64 attaches individual links 50, 50' to each other to form continuous conveyor 18, while providing flexibility for turning corners in e.g., an oval configuration. The conveyor link arrangement allows direct motion power transfer from the drive gear and is suitable for most applications. A chain drive (not shown) could be used to help with heavier articles.

Drive gear 24 comprises a top gear only (corresponding to top slot 58 (see FIG. 3) ) or a top and bottom gear (corresponding to top and bottom slots 58', 58 (see FIG. 3)) for heavier loads. Drive gear rotates about a motor driven shaft. A variable speed motor turns the shaft by means of a direct drive or belt and pulleys or chain and sprockets. The drive shaft is attached to the drive gear 24. Spacers in the drive gear mechanism 24 provide for recesses for foot 60 and screw arrangement 54.

As shown in FIGS. 3 and 4, conveyor 18 travels on conductor bar 62 by aid of link foot 60. Conductor bar 62 is supported by angle 92 and secured by connector (e.g., screw 94). Angle 92 is fasted to inverted angle 96 by a screw/washer/nut arrangement 98. Inverted angle 96 is secured to structure support 100 by a screw/nut/washer arrangement 102. Conveyor 18 is given vertical support by outer guide 104 which is attached to inverted angle 96 by a screw/washer/nut arrangement 106. Interior vertical support is provided by inner guide 108 which is attached to angles 92 and by a screw/washer/nut arrangement 110.

Figure 5:
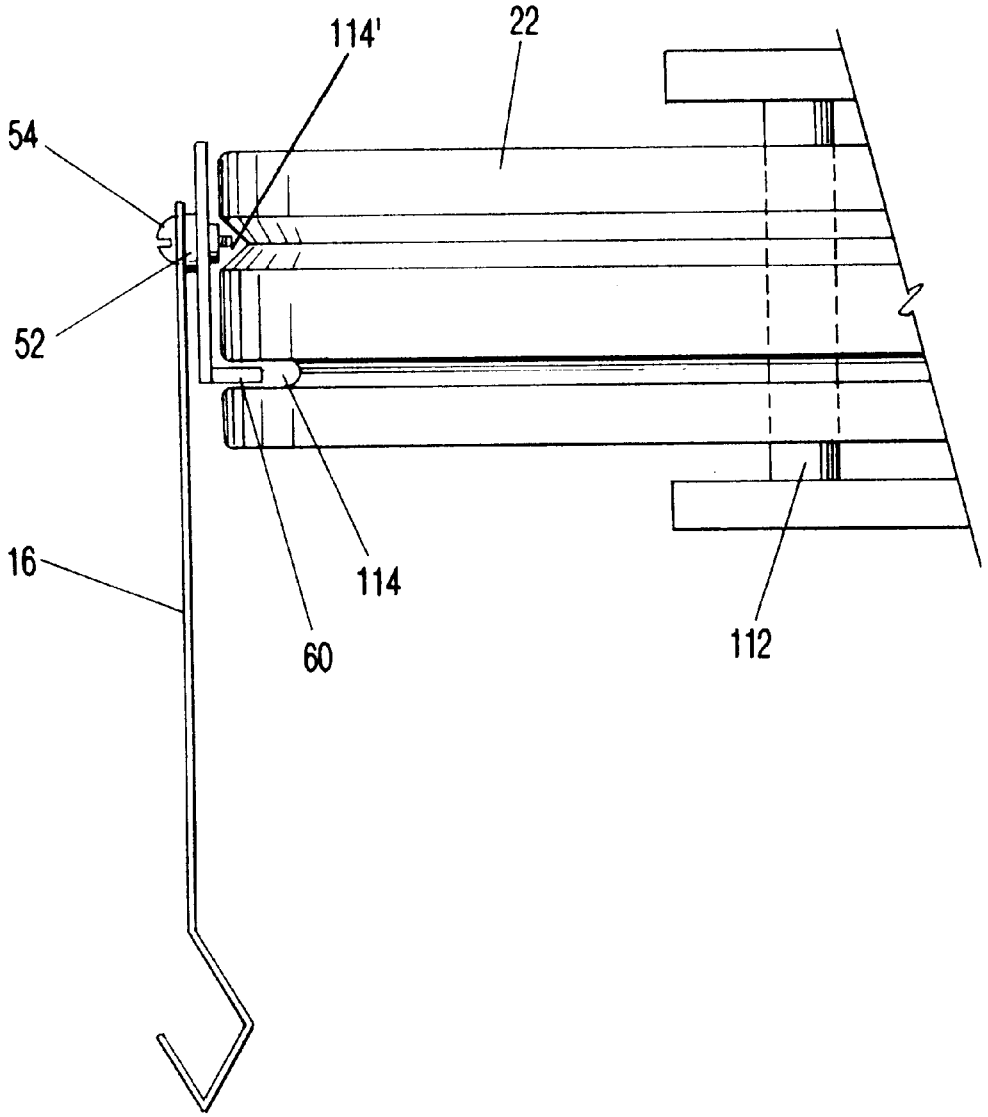
FIG. 5 is drive gear and pulley assembly configuration of the invention of FIG. 1.

FIG. 5 illustrates, in detail, the pulley arrangement for allowing conveyor 18 to rotate through the system. Idler 22 rotates about shaft 112. Idler 22 comprises recesses 114, 114' for foot 60 and screw arrangement 54, respectively, on hook 16.

Direct current for plating is passed to parts 12 being plated through hook 16, link 50, link foot 60, conductor bar 62, cable connector 66, and conductor bar/cable connector screw 68. Additional direct current can be supplied to links 50, 50' by means of exposed cable (e.g., copper cable) or brushes. Silver plating of the conductor/conveyor bar 18 aids corrosion protection, direct current power transfer, and provides a surface with high lubricity for the conveyor link feet 60, which are also preferably silver plated.

As can be seen, other part attachment devices besides hooks 16 can be utilized in accordance with the present invention. Likewise, hooks 16 or other attachment devices may be attached to conveyor 18 by various means. The present invention is not limited to the particular embodiments shown.

Conveyor belt 18 pulls hooks 16 and parts 12 to be plated through slots 72 in the ends of process tanks or boxes 74, as shown in FIGS. 6 and 7. FIG. 6 shows an embodiment of the invention for flat parts whereas FIG. 7 shows an embodiment of the invention with angled or non-planar parts. Tanks 74 can be for any type of fluid process (e.g., cleaning, degreasing, acid treatment, rinsing, plating, stripping, etc.). The slots 72 need to be wide enough for part 12 to pass through, but narrow enough to keep solutions in tanks 74. Overflow or solution which exits tanks 74 may go to an outer tank or reservoir tank (e.g., see overflow tank 76 and reservoir tank 78). FIG. 6 illustrates a narrow slot 72 for allowing passage of a narrow, flat part 12. FIG. 7 illustrates an alternate slot 84 for an angled part 86. Horizontal flaps 88, 88', typically on the outside of the tank, allow for horizontal adjustment of the slot 84 around part 86 and vertical flaps 90, 90', typically on the inside of the tank allow for vertical adjustment of angled part 86. As can be seen, slots in tanks or boxes may need to be adjusted for each part to be plated.

FIG. 6 illustrates that tanks or boxes 74 may comprise entry/exit guides 116, 116' to aid parts 12 from entering and leaving tanks 74. Additional guides 118, may be placed inside the tanks 74 to prevent parts 12 from swaying due to fluid turbulence or high pressure spray. Guides 116, 118 may be made of any material which is resistant to the solution in the tank, such as stainless steel wire, plastic covered wire, plastic chord or plastic framework.

Figure 8:
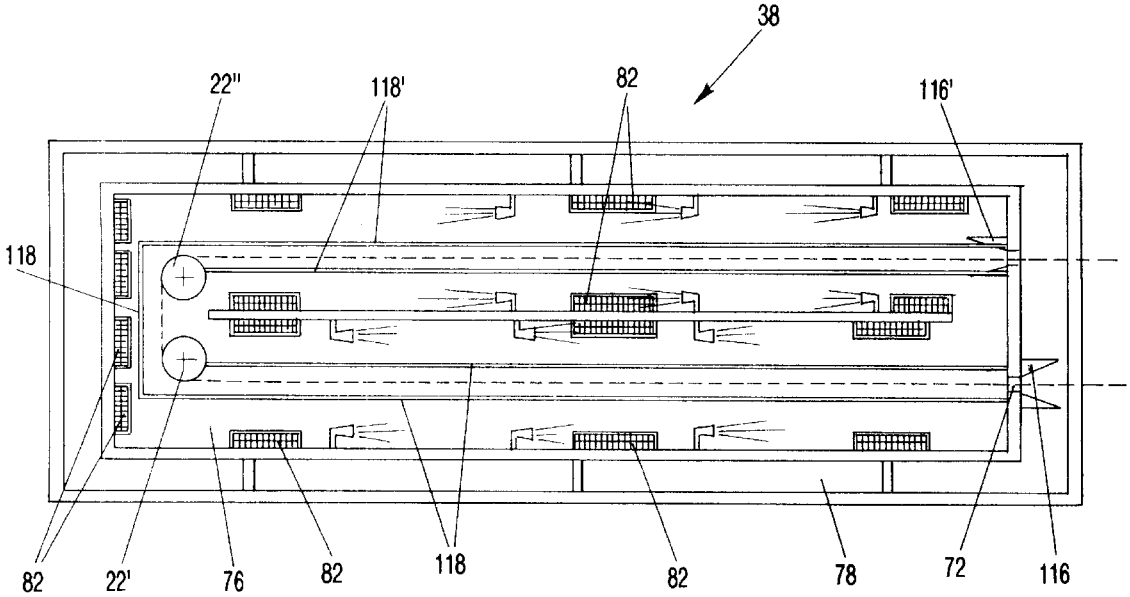
FIG. 8 is a top view of the preferred plating tank configuration of the invention of FIG. 1.

FIG. 8 is a top view of the preferred plating tank 38 of the present invention. Anode baskets 82 or anodes which hang over or present at the edges of the plating tank (not shown) may be utilized in accordance with the present invention. As can be appreciated by one skilled in the art, any type of anode configuration may be utilized in accordance with the present invention. Anode baskets 82, may contain chips, slugs, sheets or other anode material being plated. Electrical leads are provided to anode baskets 82. Mesh (not shown) may be placed over anode baskets 82 to prevent particle contamination of the tank 74.

In the preferred embodiment, smaller tanks (e.g., upper overflow tank 76) are disposed within larger tanks (e.g., reservoir tank 78) so that tank solutions can be allowed to overflow and recirculate via pumps 80 (FIG. 2). Solution jets may be provided to tanks to improve circulation of solutions. Multiple pumps may be provided within individual tanks, particularly in larger tanks such as the plating tank, so that the solution may remain homogeneous and at the same temperature throughout. Tanks 74 are preferably made of a material resistant to the solution contained in the tanks. Acrylic, polypropylene, and steel lined with rubber, are generally suitable for typical metal plating tanks.

Figure 10:
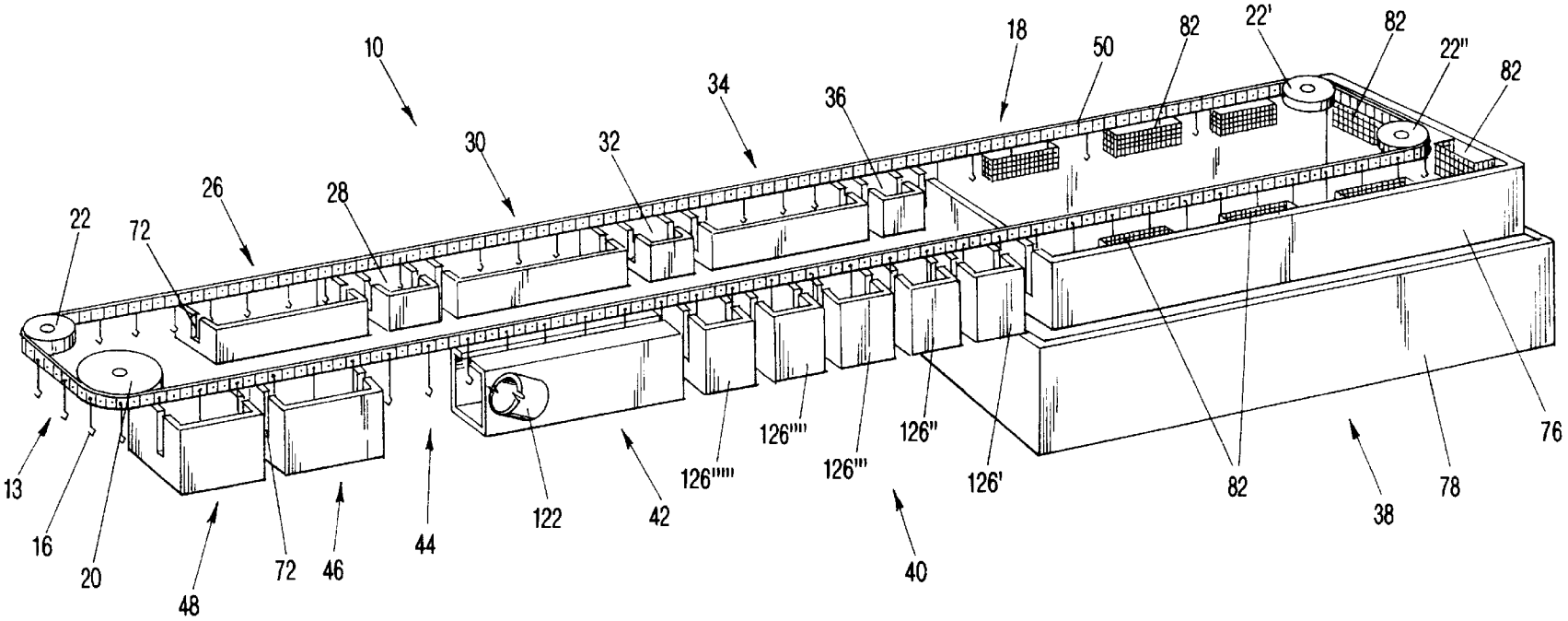
FIG. 10 is a flowchart view of the preferred rinse configuration of the invention of FIG. 1.

FIG. 10 shows the preferred rinse arrangement 40 following plating 38. Rinsing following plating is tripled or quadrupled in order to remove all plating chemicals from the surface of the plated part 12. After plating 38, the preferred embodiment for rinsing 40 comprises multiple boxes 126 (e.g., 3–4 boxes). These rinse boxes 126 may be joined to save space. The reservoirs can be placed beneath the nickel tank. The reservoirs for 126, 28, 32, 36, and 48 can be placed under the dryer. In the preferred embodiment, each rinse box 126 comprises a separate rinse reservoir for evaporation. After plating 38, the first rinse box 126' may have a high metal concentration, the next box 126" will have a lesser metal concentration, the next box 126'" a lower concentration, and so on, until the last box 126"" has nearly clean water. Deionized water is preferably used to make up the reservoirs. If the plating bath 38 is heated, such as in nickel plating, the metal laden water from the first reservoir can be used to replace the loss of volume in the plating bath 38 due to evaporation. The water in the second reservoir is then pumped to the first reservoir; the water in the third reservoir is pumped to the second reservoir; and the water emptied from the final reservoir is replaced with more deionized water. This system has been found to eliminate the need for effluent treatment of metal.

FIG. 9 shows the preferred convection dryer of the present invention. Wet, plated parts 12 are dried in a countercurrent, hot-air convection dryer 42. Dryer 42 comprises a box in which the hot air is introduced to the part 12 via nozzles. A bottom mesh wicking screen 120 may be utilized to wick away moisture from part 12 by touching the bottom of part 12, resulting in a spot-free part 12. Dryer 42 box and/or wick screen 120 may be adjusted upwards or downwards to accommodate the size and shape of the part 12. Hot air enters dryer 42 through a duct 122 that supplies hot air to the dryer 42, preferably on two sides of the dryer 42. Air guides 124 direct the hot air towards the opposite end of the dryer 42. FIG. 9 also illustrates slot 72 through which hook 16 and part 12 enters dryer 42.

After plated articles 12 have been removed from hooks 16, as shown in FIG. 10 hooks 16 pass through a stripping box 46, where an anodic stripping fluid removes plating built up from the hook tips. This process allows hooks 16 to be used for a longer period of time without maintenance or replacement. A cathode (not shown) in the stripping box 46 is negatively charged, while hook 16 is positively charged. The cathode may sit on the bottom of strip tank 46 and rise up the tank sides, where it is connected to direct current.

In the preferred embodiment of the invention, most fluid streams are recycled or reintroduced into the process stream. The invention utilizes countercurrent rinsing as follows: Fresh rinse water is recirculated after the nickel rinses. This water slowly overflows to the acid rinse and is recirculated there. Next, the water overflows to the electrocleaner rinse, recirculated, overflowed to the degrease rinse, recirculated, overflowed to the hook strip rinse, and recirculated, and finally drained. One water source thereby provides rinsing for five operations.

Figure 11:
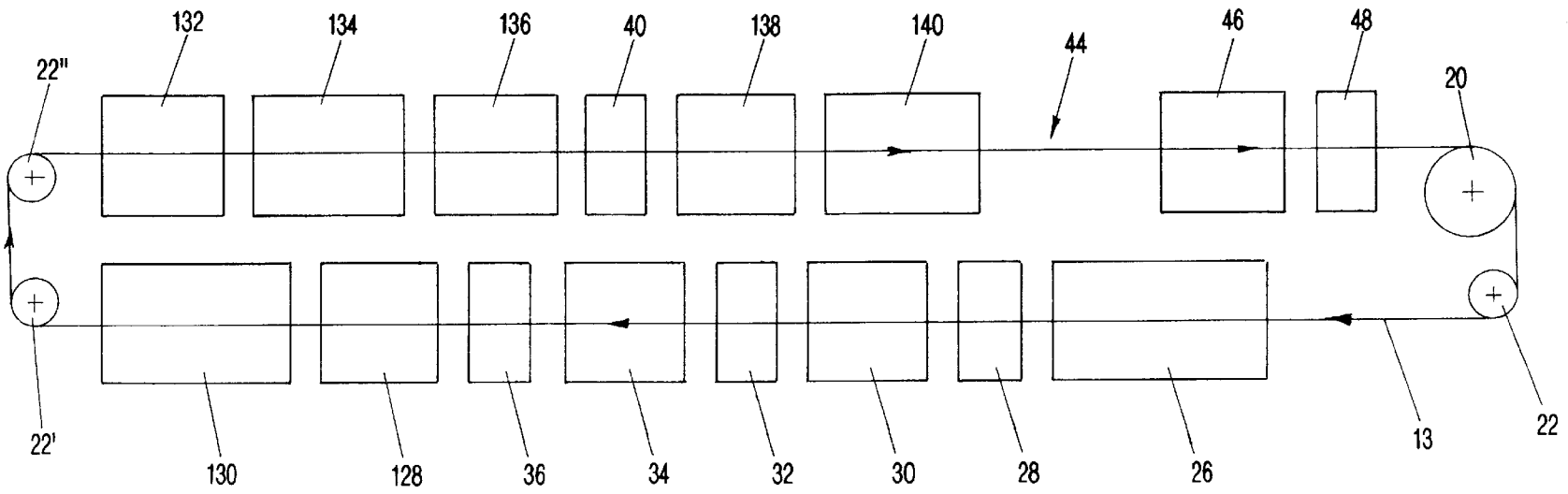
FIG. 11 is a flowchart of an alternative embodiment for alloy plating using the invention of FIG. 1.
Figure 12:
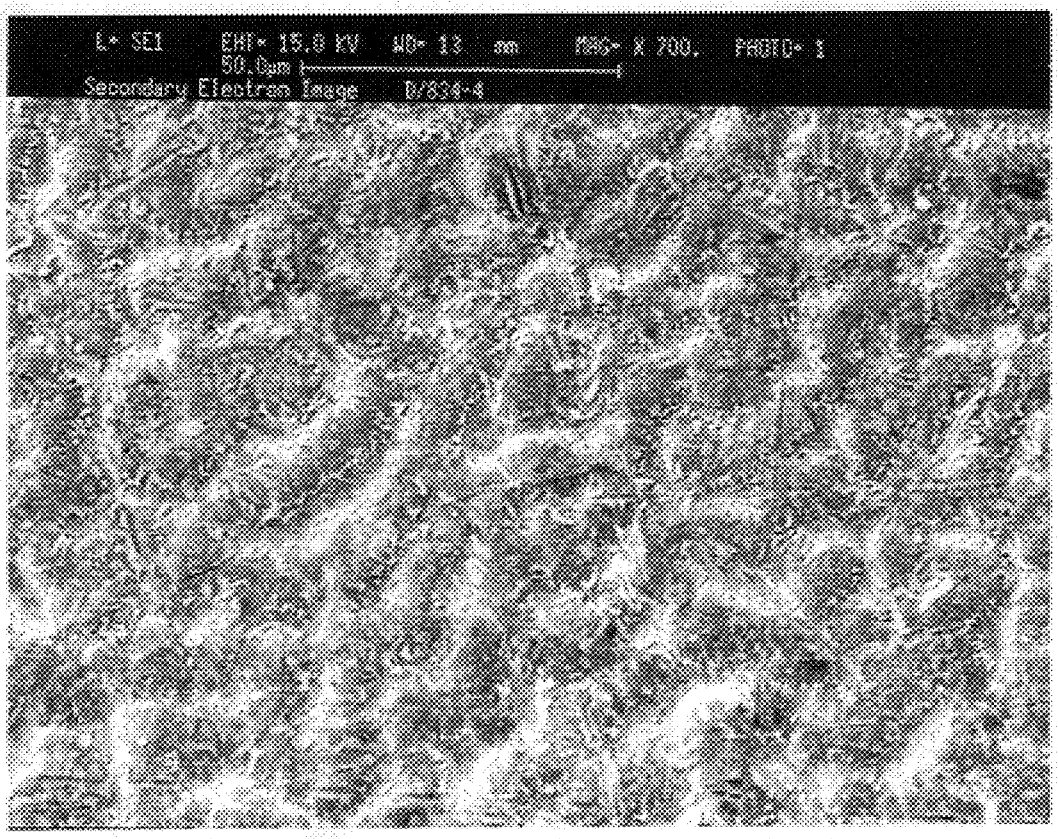
FIG. 12 is a scanning electron photomicrograph of Sn/Bi coating in SEI mode at 700× magnification.
Figure 13:
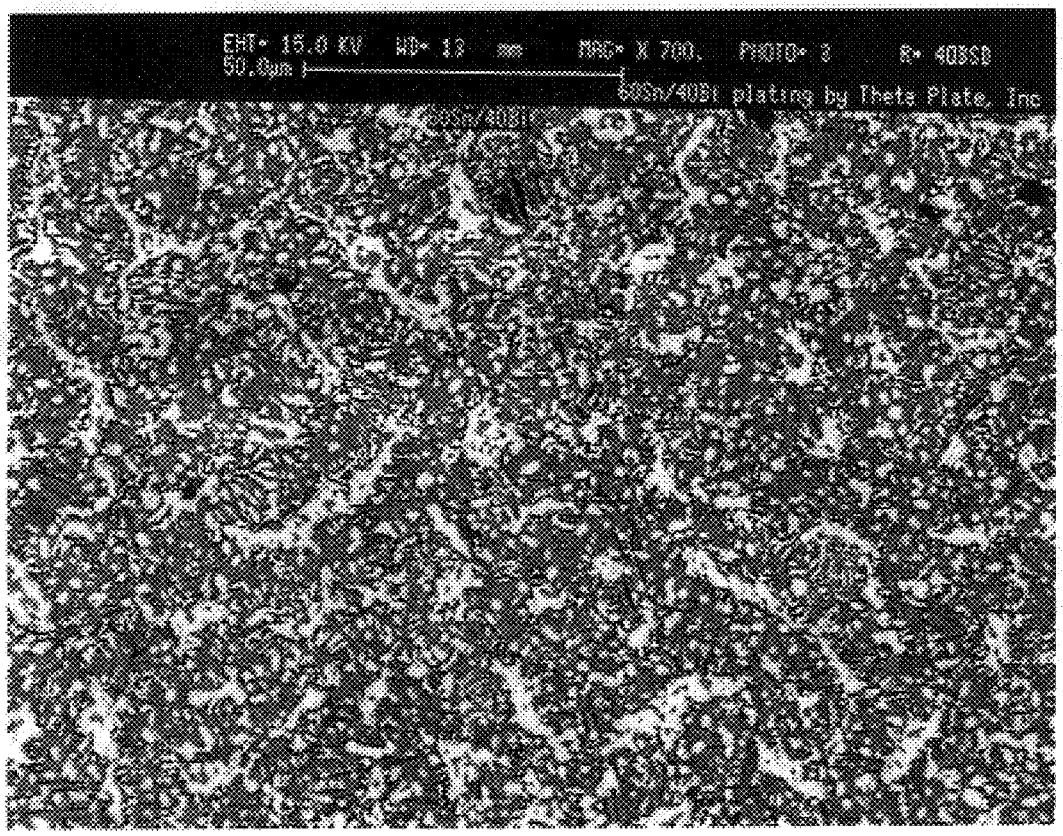
FIG. 13 is a scanning electron photomicrograph of Sn/Bi coating in composition mode at 700× magnification.

In an alternative embodiment of the invention, shown in FIG. 11, alloy plating is possible using the plater 10 of the present invention. FIG. 11 is one example of numerous types of alloy plating possible, namely tin/bismuth plating. For instance, short lead frame strips used in the integrated circuit industry could be plated in accordance with the alloy method of the present invention. Tin/bismuth is preferable to tin/lead plating due to the inherent environmental problems with lead. Heretofore, it has not been possible to easily and inexpensively plate tin/bismuth in a homogeneous manner. Nor, was it possible due to the voltage differences required to plate tin and bismuth in the same bath. The multiple plate process of the present invention overcomes these problems. FIGS. 12 and 13 illustrate scanning electron photomicrographs of the resulting homogeneous alloy structure of tin/bismuth plating. In FIG. 11, one process for tin/bismuth or other alloy plating (such as tin/lead plating, titanium/cadmium, tin/nickel, and tin/zinc) is as follows, many of which steps are similar or the same and described above in reference to FIG. 2: load parts 13; degrease 26; rinse 28; clean 30; rinse 32; acid clean 34; rinse 36; tin plating 128; bismuth plating 130; tin plating 132; bismuth plating 134; tin plating 136; rinse 40; flux 138; reflow 140; unloading part 44; strip hooks 46; rinse hooks 48; and reload parts 13. The differences in the alloy plating is that different baths are used for each metal (some baths 128, 132 and 136 for tin, and other baths 130 and 134 for bismuth). As can be appreciated by one skilled in the art, there could be one bath for each alloy or multiple alloys. Likewise, some alloy plating is achievable in a single tank (not shown). For tin/bismuth, five to seven layers achieve a good product, with the final layer being tin. The alloy weight composition can be regulated by the length of time in the various tanks or by the amount of direct current in the various tanks. If the same electrolyte is used in the tin tank and the bismuth tank, such as methane sulfonic acid, or fluroboric acid, then there is no need for rinsing between the tin and bismuth tanks. Alternatively, rinsing can be provided between plating tanks. If tin is the final plate, then there is no need for metal saving rinses, as tin is not considered an environmental hazard. Following plating of the metal layers, the articles/parts 12 pass through a flux spray 138 or flux bath and then to a heated reflow station 140. The reflow 140 can be as short as a few seconds and be accomplished by infrared radiation, hot oil designed for reflow, or by vapor phase with solvent designed for such. Wash and dry steps might be required to remove residues from the reflow 140 step (not shown). The method of reflow will determine if wash and dry steps are required. Optimization of the length of time in the reflow 140 is based on the amount of tin intermetallics with the basic material required for adhesion, and the thickness and number of the layers desired.

Industrial Applicability:

The invention is further illustrated by the following non-limiting example.

EXAMPLE

The present invention, as depicted in FIG. 1, was used to plate nickel onto steel parts. The conveyor speed was approximately 3–4" per minutes, with 1–1.5 revolutions per minute of drive gear. The plater was run continuously for several months (3 shifts per day), producing hundreds of thousands of parts. The plater was 30' in length with approximately 180 hooks. One flat part plated was for the bottom of a cellular phone charger. One angular part plated was a lever on a weedeater. The present invention was tested to 750 amps of direct current for nickel plating. Auxiliary brush or exposed cable contacts were placed approximately every 18" to solve arcing problems. The processes shown in the flowchart of FIG. 2 were used for flat and angled parts. The parts had a hole in them which allowed for disposing the parts on the hooks. The nickel plating tank arrangement consisted of an approximately 300 gallon tank inside a 400 gallon tank. Anodes were placed in baskets. Each small rinse box (except for final rinse arrangement) was approximately 5" long. The sizes of the various components were as follows: degreaser, electrocleaner and acid stations, 48"×12" wide×8" high; degreaser, electrocleaner and acid reservoir tanks, 60 gallons, 60"×18" wide×16" high; rinse boxes, 5"×9" wide×9" tall; rinse reservoirs, 16"×16"×16", 17 gallon; rinse water flow, 3 gpm; nickel rinse reservoirs #1 and #2, 60"×22"×20" deep, 110 gallon; nickel rinse reservoirs #3 and #4, 30"×22"×20" deep, 55 gallon; and rinse box flows, 0.5 gpm, spray or laminar.

The preceding example can be repeated with similar success by substituting the generically or specifically described reactants and/or operating conditions of this invention for those used in the preceding example.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, are hereby incorporated by reference.

What is claimed is:

1. A continuous plating system for plating articles comprising:

multiple baths, wherein at least one bath comprises a plating bath;

a conveyor system for passing said articles through said multiple baths; and a synthetic resin polymer support bar to support said conveyor system.

2. The plating system of claim 1 wherein said conveyor system comprises a conductor means for providing electricity to the articles while being passed.

3. The plating system of claim 2 further comprising additional direct current means.

4. The plating system of claim 3 wherein said additional direct current means comprises exposed cable or brushes.

5. The plating system of claim 1 wherein said conveyor system comprises carriers for carrying the articles.

6. The plating system of claim 5 wherein said carriers are electrical conductors.

7. The plating system of claim 5 wherein said carriers comprise hooks which hook into openings in the articles.

8. The plating system of claim 7 wherein said plating bath comprises at least one anode for plating at least one anodic substance onto the articles.

9. The plating system of claim 1 wherein said plating bath comprises an upper tank disposed within a lower tank for providing overflow and recirculation of a plating solution.

10. The plating system of claim 1 wherein said plating bath comprises a narrow opening and a narrow exit corresponding in shape and width to the articles.

11. The plating system of claim 10 wherein said opening and exit comprise adjustment means for changing the shape and size of said opening and exit.

12. The plating system of claim 1 wherein said plating bath comprises multiple pumps for providing even plating conditions to the articles.

13. The plating system of claim 1 wherein said plating bath comprises multiple spray jets for providing even circulation and plating to the articles.

14. The plating system of claim 1 further comprising guides for guiding the articles.

15. The plating system of claim 14 wherein said guides comprise internal guides within at least one of said multiple baths for preventing sway of the articles.

16. The plating system of claim 14 further comprising external guides external to at least one of said multiple baths for providing ease of movement of the articles into said bath.

17. The plating system of claim 1 wherein the articles comprise planar articles.

18. The plating system of claim 1 wherein the articles comprise non-planar articles.

19. The plating system of claim 1 which is in an oval configuration.

20. The plating system of claim 1 further comprising a dryer in line with said continuous plating system and positioned after said multiple baths, said dryer comprising:

a box comprising a heated fluid;

an entry opening for the articles to enter said box; and an exit opening for the articles to exit said box.

21. The plating system of claim 20 further comprising means for wicking moisture from the articles.

22. The plating system of claim 21 wherein said wicking means comprises a mesh material disposed in said box.

23. The plating system of claim 21 wherein said wicking means is disposed at a bottom of said box.

24. The plating system of claim 1 further comprising a rinse system in line with said continuous plating system and positioned after said multiple baths, said rinse system comprising:

an initial rinse station wherein a substance from said multiple baths is rinsed from the articles, said initial rinse station comprising an effluent with a higher concentration of the substance;

at least one additional rinse station wherein the substance is further rinsed from the articles, said additional rinse station comprising an effluent with a lower concentration of the substance; and means for recycling effluent from said rinse station back into said continuous plating system.

25. The plating system of claim 24 comprising at least four rinse stations.

26. The plating system of claim 1 wherein said at least one bath comprises at least one process bath selected from the group consisting of cleaning, electrocleaning, degreasing, rinsing, drying, fluxing, reflowing and stripping.

27. The plating system of claim 1 comprising at least the following baths in the following order:

a cleaning bath;

a rinsing bath;

a plating bath; and a final rinsing bath.

28. The plating system of claim 27 further comprising a drying station subsequent to said final rinsing bath.

29. The plating system of claim 1 wherein at least one of said multiple baths comprises a stripping bath positioned after said plating bath for stripping said carriers of a substance plated on said carriers in said plating bath.

30. The plating system of claim 1 comprising at least two plating baths, each of said plating baths comprising a different material to be plated on the articles and for alloy plate formation.

31. The plating system of claim 30 wherein said alloy plate comprises tin and bismuth.

32. The plating system of claim 31 comprising at least five plating baths in the following order and comprising the following in solution to be plated on the articles: tin, bismuth, tin, bismuth and tin.

33. The plating system of claim 30 wherein said alloy plate comprises at least one alloy selected from the group consisting of tin alloys, bismuth alloys, lead alloys, titanium alloys, cadmium alloys, nickel alloys, and zinc alloys.

34. The plating system of claim 1 wherein said conveyor system passes said articles through said multiple baths while completely submerging the articles through at least one of said baths.

35. The plating system of claim 34 wherein said conveyor system conveys said articles through said multiple baths at substantially a same vertical level within and between said baths.

36. A continuous plating system for plating articles comprising:

multiple baths, wherein at least one bath comprises a plating bath;

a conveyor system for passing said articles through said multiple baths;

a dryer in line with said continuous plating system and positioned after said multiple baths, said dryer comprising:

a box comprising a heated fluid;

an entry opening for the articles to enter said box; and an exit opening for the articles to exit said box; and means for wicking moisture from the articles.

37. The plating system of claim 36 wherein said wicking means comprises a mesh material disposed in said box.

38. The plating system of claim 36 wherein said wicking means is disposed at a bottom of said box.

39. The plating system of claim 36 wherein said conveyor system passes said articles through said multiple baths while completely submerging the articles through at least one of said baths.

40. The plating system of claim 39 wherein said conveyor system conveys said articles through said multiple baths at substantially a same vertical level within and between said baths.

41. The plating system of claim 36 comprising at least two plating baths, each of said plating baths comprising a different material to be plated on the article and for alloy plate formation.

42. The plating system of claim 41 wherein said alloy plate comprises tin and bismuth.

43. The plating system of claim 42 comprising at least five plating baths in the following order and comprising the following in solution to be plated on the articles: tin, bismuth, tin, bismuth and tin.

44. The plating system of claim 41 wherein said alloy plate comprises at least one alloy selected from the group consisting of tin alloys, bismuth alloys, lead alloys, titanium alloys, cadmium alloys, nickel alloys, and zinc alloys.

* * * * *